US009086061B2

(12) United States Patent
Zhang et al.

(10) Patent No.: US 9,086,061 B2
(45) Date of Patent: Jul. 21, 2015

(54) ENERGY RECOVERY HYDRAULIC SYSTEM

(71) Applicant: Caterpillar Inc., Peoria, IL (US)

(72) Inventors: Jiao Zhang, Naperville, IL (US); Gang Wen, Dunlap, IL (US); Pengfei Ma, Naperville, IL (US); Tonglin Shang, Bolingbrook, IL (US); Dayao Chen, Bolingbrook, IL (US); Bryan J. Hillman, Peoria, IL (US); Vickram Murugesan, Joliet, IL (US)

(73) Assignee: Caterpillar Inc., Peoria, IL (US)

( * ) Notice: Subject to any disclaimer, the term of this patent is extended or adjusted under 35 U.S.C. 154(b) by 413 days.

(21) Appl. No.: 13/693,509

(22) Filed: Dec. 4, 2012

(65) Prior Publication Data

US 2014/0150415 A1 Jun. 5, 2014

(51) Int. Cl.

| | |
|---|---|
| ***F15B 21/14*** | (2006.01) |
| ***F04B 7/02*** | (2006.01) |
| ***F04B 49/00*** | (2006.01) |
| ***F15B 1/02*** | (2006.01) |

(52) U.S. Cl.

CPC ..... *F04B 7/02* (2013.01); *F04B 49/002* (2013.01); *F15B 1/024* (2013.01); *F15B 21/14* (2013.01); *F15B 2211/20507* (2013.01); *F15B 2211/212* (2013.01); *F15B 2211/3058* (2013.01); *F15B 2211/30565* (2013.01); *F15B 2211/6306* (2013.01); *F15B 2211/6313* (2013.01); *F15B 2211/7053* (2013.01); *F15B 2211/88* (2013.01)

(58) Field of Classification Search

CPC .. F15B 21/14; F15B 1/024; F15B 2211/3058; F15B 2211/88

See application file for complete search history.

(56) References Cited

U.S. PATENT DOCUMENTS

| | | | | |
|---|---|---|---|---|
| 6,378,301 | B2 * | 4/2002 | Endo et al. | 60/414 |
| 6,434,864 | B1 | 8/2002 | Epshteyn | |
| 6,634,653 | B2 | 10/2003 | Chatterjea | |
| 7,269,944 | B2 | 9/2007 | Zhang et al. | |
| 7,516,614 | B2 | 4/2009 | Bitter | |
| 7,634,911 | B2 * | 12/2009 | Brinkman | 60/414 |
| 2005/0196288 | A1 | 9/2005 | Cherney | |
| 2008/0110166 | A1 | 5/2008 | Stephenson et al. | |
| 2009/0000290 | A1 | 1/2009 | Brinkman | |
| 2009/0241534 | A1 * | 10/2009 | Tikkanen et al. | 60/413 |

FOREIGN PATENT DOCUMENTS

| | | | |
|---|---|---|---|
| JP | 08-014201 | A | 1/1996 |
| JP | 2005-155230 | A | 6/2005 |

* cited by examiner

*Primary Examiner* — Thomas E Lazo

(74) *Attorney, Agent, or Firm* — Leydig Voit & Mayer, Ltd.

(57) ABSTRACT

A method and system for accumulating and using recovered hydraulic energy that includes a hydraulic actuator and a pump configured to supply pressurized fluid to the hydraulic actuator. An energy recovery system includes a hydraulic motor, a charge valve and an accumulator configured to store fluid from the hydraulic actuator. The charge valve is operatively connected between the hydraulic actuator and the accumulator and between the accumulator and the hydraulic motor and is configured to place the hydraulic actuator in fluid communication with the accumulator and to place the accumulator in fluid communication with the hydraulic motor. A directional valve is operatively connected between the pump and the hydraulic actuator. The directional valve is configured to place the pump in fluid communication with the hydraulic actuator and to direct the flow of hydraulic fluid exiting the hydraulic actuator to the charge valve in an energy recovery mode.

20 Claims, 2 Drawing Sheets

ENERGY RECOVERY HYDRAULIC SYSTEM

TECHNICAL FIELD

This patent disclosure relates generally to energy recovery and, more particularly to a system and method for accumulating and using recovered hydraulic energy.

BACKGROUND

A work machine may be used to move heavy loads, such as earth, construction material, and/or debris, and may include, for example, a wheel loader, an excavator, a front shovel, a bulldozer, a backhoe, and a telehandler. The work machine may utilize a work implement to move the heavy loads. The work implement of the work machine may be powered by a hydraulic system that may use pressurized fluid to actuate a hydraulic actuator to move the work implement.

During operation of the work machine, the implement may be raised to an elevated position. As the implement may be relatively heavy, the implement may gain potential energy when raised to the elevated position. As the implement is released from the elevated position, this potential energy may be converted to heat when pressurized hydraulic fluid is forced out of the hydraulic actuator and is throttled across a valve and returned to a tank. Typically, the conversion of potential energy into heat may result in an undesired heating of the discharged hydraulic fluid, which may require that the work machine possess additional cooling capacity. Recovering that lost or wasted potential energy for reuse may improve work machine efficiency.

One system designed to recover or recycle the energy associated with lowering a load is disclosed in U.S. Pat. No. 7,269,944. The hydraulic circuit disclosed in that reference includes a hydraulic cylinder and a pump configured to supply hydraulic fluid to the hydraulic actuator. The hydraulic circuit also includes an energy recovery system operatively connected between the hydraulic actuator and the pump that is configured to store pressurized fluid from the hydraulic actuator under an overrunning load condition. The energy recovery system can include a high pressure accumulator, a tank accumulator, a high pressure charge valve and a high pressure discharge valve. The hydraulic circuit further includes a control valve assembly including two pump-to-cylinder independent metering control valves and two cylinder-to-tank independent metering control valves. A disadvantage associated with this hydraulic circuit is the number of control valves and the use of two accumulators, which can increase the complexity of the hydraulic circuit.

SUMMARY

The disclosure describes, in one aspect, a hydraulic system that includes a hydraulic actuator and a pump configured to supply pressurized fluid to the hydraulic actuator. An energy recovery system includes a hydraulic motor, a charge valve and an accumulator configured to store fluid from the hydraulic actuator. The charge valve is operatively connected between the hydraulic actuator and the accumulator and between the accumulator and the hydraulic motor and is configured to selectively place the hydraulic actuator in fluid communication with the accumulator and to selectively place the accumulator in fluid communication with the hydraulic motor. A directional valve is operatively connected between the pump and the hydraulic actuator. The directional valve is configured to selectively place the pump in fluid communication with the hydraulic actuator and to selectively direct the flow of hydraulic fluid exiting the hydraulic actuator to the charge valve in an energy recovery mode.

In another aspect, the disclosure describes a machine including a work implement and a hydraulic system configured to actuate the work implement. The hydraulic system includes a hydraulic actuator having a first chamber and a second chamber, a pump configured to supply pressurized fluid to the hydraulic actuator and an energy recovery system. The energy recovery system includes a hydraulic motor, a charge valve and an accumulator configured to store fluid from the hydraulic actuator. The charge valve is operatively connected between the hydraulic actuator and the accumulator and between the accumulator and the hydraulic motor and is configured to place the hydraulic actuator in fluid communication with the accumulator and to place the accumulator in fluid communication with the hydraulic motor. A directional valve operatively connected between the pump and the hydraulic actuator. The directional valve is configured to selectively place the pump in fluid communication with the first chamber of the hydraulic actuator and in fluid communication with the second chamber of the hydraulic actuator. The directional valve is configured to selectively direct the flow of hydraulic fluid exiting the hydraulic actuator to the charge valve.

In yet another aspect, the disclosure describes a method for recovering energy in a hydraulic circuit including a pump and a hydraulic cylinder. Fluid exiting the hydraulic actuator is directed to an accumulator in a first operating condition. Fluid from the hydraulic actuator is directed to the accumulator and from the accumulator to a hydraulic motor in a second operating condition. Fluid from the accumulator is directed to the hydraulic motor in a third operating condition.

DETAILED DESCRIPTION

Figure 1:
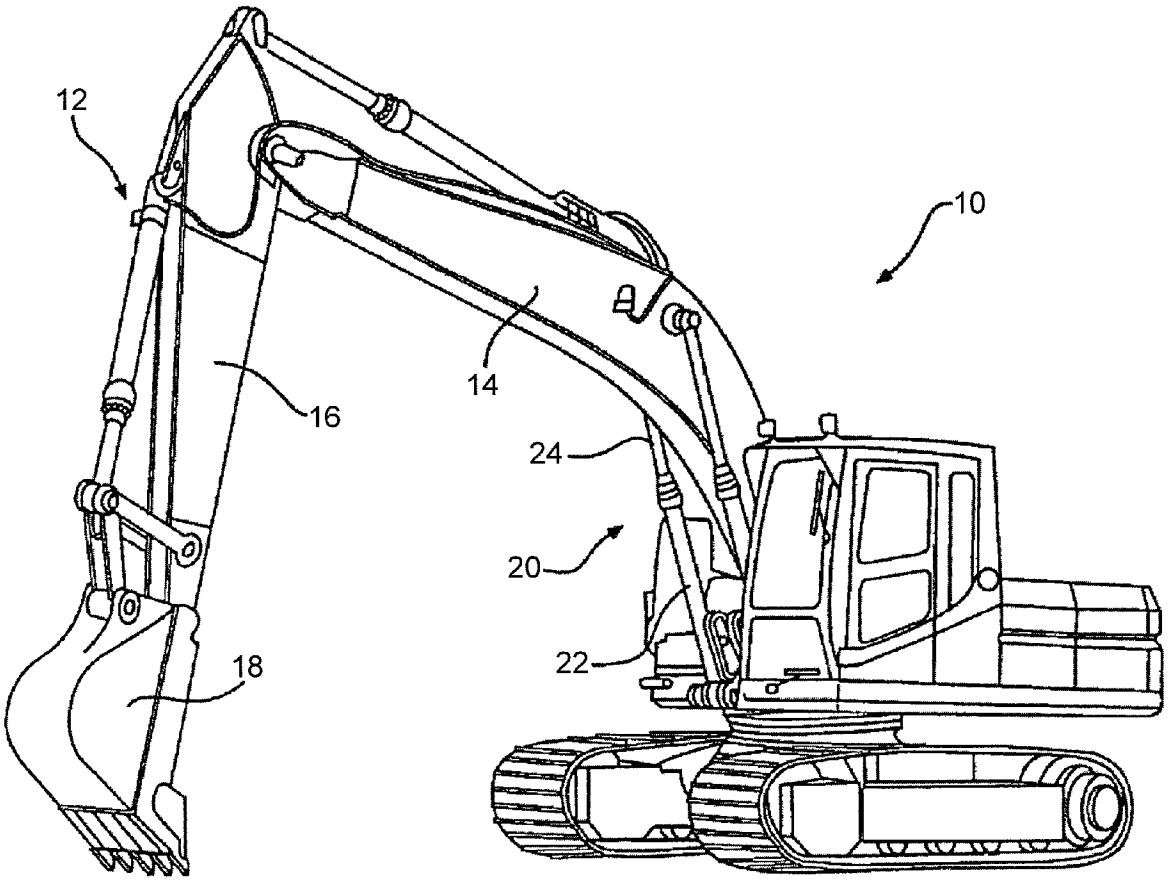
FIG. 1 is a schematic view of an exemplary work machine suitable for use with the apparatus and method according to the present disclosure.

This disclosure relates to a hydraulic system that provides energy recovery and, more particularly, to a hydraulic system and method for accumulating and using recovered hydraulic energy. With particular reference to FIG. 1, an exemplary machine 10 is disclosed. In this instance, the illustrated machine 10 is an excavator that includes a work implement 12 that may include a boom 14, a stick 16, and a bucket 18. Operations performed by the implement 12 may include, for example, lifting, lowering, and otherwise moving a load (not shown).

While the hydraulic system and method is illustrated and described in connection with an excavator, the system and method disclosed herein has universal applicability in various other types of machines as well. The term "machine" may refer to any machine with a hydraulically powered work implement that performs some type of operation associated with an industry such as mining, construction, farming, transportation, or any other industry known in the art. For example, the machine 10 may be an earth-moving machine, such as a wheel loader, excavator, dump truck, backhoe, motor grader, material handler or the like.

The implement 12 may be moved to perform its various functions by one or more hydraulic actuators 20 that may be connected between the machine frame and the moving parts of the implement. In the illustrated embodiment, two hydraulic actuators 20 are provided with each being configured as a double acting hydraulic cylinder with a housing 22 and a piston 24. Elements of the hydraulic actuators 20 may be seen in greater detail in FIG. 2. While the illustrated embodiment has two hydraulic actuators 20, the hydraulic system may include only a single hydraulic actuator or more than two hydraulic actuators. Moreover, the hydraulic actuator can comprise any device configured to receive pressurized hydraulic fluid and convert it into a mechanical force and motion. For example, the hydraulic actuator 20 may additionally or alternatively include a fluid motor or hydrostatic drive train.

Figure 2:
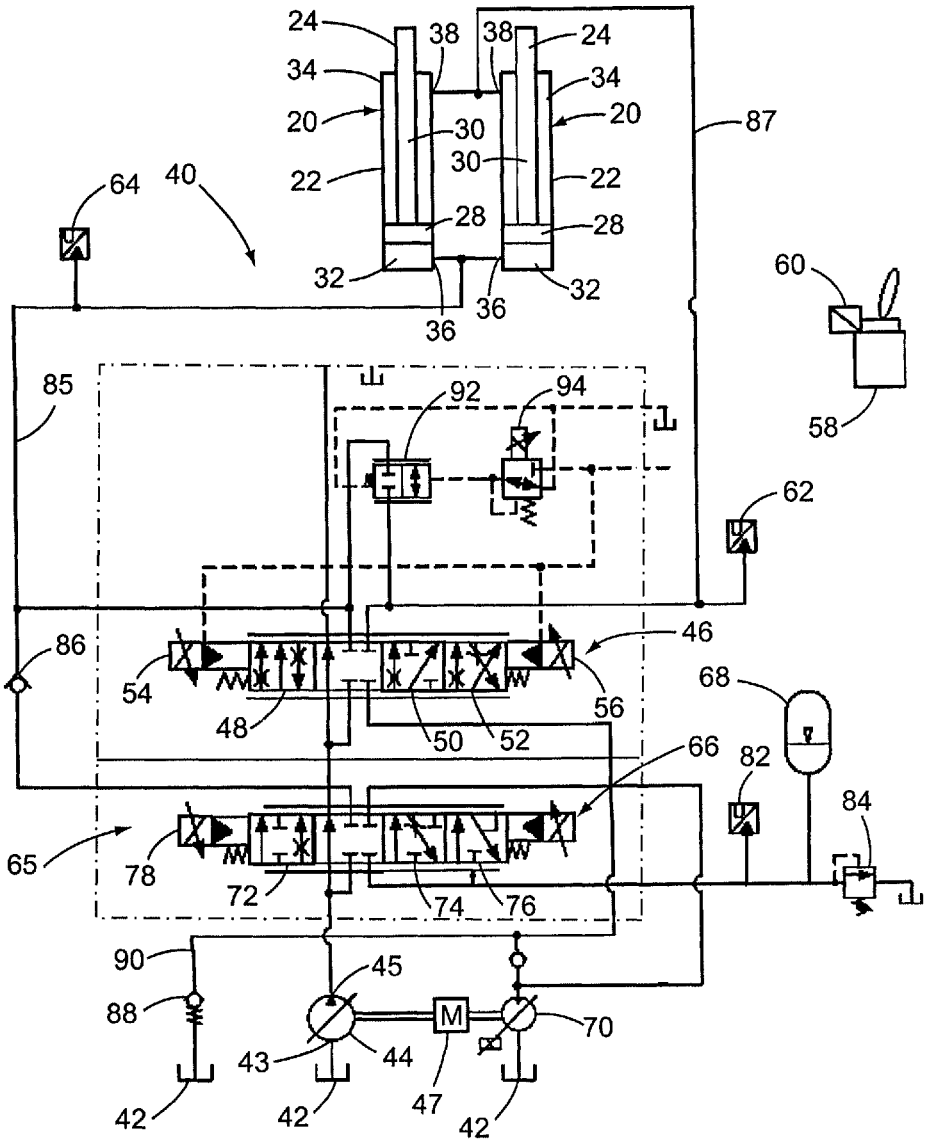
FIG. 2 is a schematic illustration of a hydraulic system according to the present disclosure.

As shown in FIG. 2, the housing 22 of the hydraulic actuators 20 may define an interior space having an inner surface. In one embodiment, the housing 22 may define a substantially cylindrically-shaped vessel having a cylindrical bore therein defining the inner surface. The piston 24 may be slidably received against inner surface of the housing 22 to allow relative movement between the piston 24 and the housing 22. The piston 24 may include a head 28 shaped to fit closely against the inner surface of the housing 22. The piston 24 may also include a rod 30 connected on one end to the head 28 and connected on another end directly or indirectly to the work implement 12.

The piston 24 may divide the internal chamber of housing 22 into a rod end chamber 34 corresponding to the portion of the internal chamber on the rod side of piston 24, and a head end chamber 32 corresponding to the portion of the internal chamber opposite to the rod side. The housing 22 may include a head end port 36 associated with the head end chamber 32 and a rod end port 38 associated with the rod end chamber 34. Pressurized hydraulic fluid may flow into and out of the head and rod end chambers 32, 34 via their respective ports 36, 38 to create a pressure differential between them that may cause movement of the piston 24.

A hydraulic circuit or system 40 may be utilized to selectively direct pressurized hydraulic fluid into and out of the hydraulic actuators 20. In one embodiment, the hydraulic system 40 may include a tank 42 and a pump 44 configured to supply pressurized fluid to the one or more hydraulic actuators 20. The tank 42 may include a source of low pressure hydraulic fluid, such as, for example, a fluid reservoir. The fluid may include a dedicated hydraulic oil, an engine lubrication oil, a transmission lubrication oil, or other suitable working fluid. The hydraulic circuit 40 may selectively draw fluid from and return fluid to tank 42 during operation of the implement 12. Although only a single tank 42 is shown, it is also contemplated that hydraulic circuit 40 may be in fluid communication with multiple, separate fluid tanks.

The pump 44 may be any type of pump that can be configured to produce a flow of pressurized hydraulic fluid and may include, for example, a piston pump, gear pump, vane pump, or gerotor pump. The pump 44 may have a variable displacement capacity, or, in the alternative, a fixed capacity for supplying the flow. The pump 44 may include a pump inlet 43 and a pump outlet 45, with the pump inlet 43, in this case, being connected to the tank 42 by a fluid line. In operation, the pump 44 may draw hydraulic fluid from the tank 42 at ambient or low pressure and may work the hydraulic fluid to pressurize it. The pressurized hydraulic fluid flow may exit through the pump outlet 54. The pump 44 may be drivably connected to a power supply 47 of the machine 10 by a countershaft, a belt, an electrical circuit, and/or in any other suitable manner. In this case, the power supply 47 comprises a motor as shown in FIG. 2. The pump 44 may be dedicated to supplying pressurized hydraulic fluid only to the hydraulic circuit 40, or alternatively, the pump 44 may also supply pressurized hydraulic fluid additional hydraulic systems of the machine 10.

For directing the extend and retract motion of the hydraulic actuators 20, the hydraulic system 40 may include a directional valve 46. As shown in FIG. 2, the directional valve 46 may be operatively connected between the pump 44 and hydraulic actuators 20 and be configured such that pressurized hydraulic fluid may be directed into and out of the head and rod end chambers 32, 34 of the hydraulic actuators 20 through selective actuation of the directional valve 46. More specifically, the directional valve 46 may be configured to direct hydraulic fluid exiting the pump 44 into either the head end or the rod end chamber 32, 34 of the hydraulic actuators 20. The directional valve 46 may also be configured to receive hydraulic fluid exiting from the head end or rod end chambers 32, 34 of the hydraulic actuators 20. As discussed in greater detail below, the directional valve 46 may be configured to direct the hydraulic fluid exiting the head end or the rod end chambers 32, 34 to the tank 42 or to an energy recovery system. Accordingly, by controlling the direction and rate of fluid flow to and from the head end and rod end chambers 32, 34 of the hydraulic actuators 20, the directional valve 46 can control the motion of the implement 12.

In the illustrated embodiment, the directional valve 46 is configured as a solenoid operated spool valve being movable from a neutral position to first, second and third positions 48, 50, 52. The directional valve 46 is illustrated in a neutral position in FIG. 2. In this case, as described further below, the first position 48 is an extend position and the second and third positions 50, 52 are faster retract and slower retract positions respectively. The directional valve 46 may include two solenoids, as shown in FIG. 2, with movement into the first position 48 being controlled by actuation of a first solenoid 54 and movement into the second and third positions 50, 52 being controlled by actuation of a second solenoid 56. Although it will be appreciated by one skilled in the art that a single solenoid may be used to move the directional valve 46 between its various positions. The directional valve 46 may be movable to any position between the first, second and third positions 48, 50, 52 to vary the rate of flow into the actuators 20, thereby affecting the speed at which the pistons 24 move in the respective actuators 20. The directional valve 46 may be actuated in any suitable manner including electrically actuated, hydraulically actuated, mechanically actuated or pneumatically actuated.

The operation of the directional valve 46, and thereby extension and retraction of the hydraulic actuators 20, may be controlled by an operator input device 58 such as a joystick as shown in FIG. 2. It is contemplated, however, that the operator input device 58 may embody different or additional control devices such as, for example, pedals, levers, switches, buttons, wheels and other control devices known in the art. For detecting the position of the operator input device 58, an input device sensor 60 may be provided that communicates with the directional valve 46. This communication may be facilitated by a controller. To monitor the pressure in the rod end chamber 34 of the cylinder, the hydraulic system 40 can include a rod end pressure sensor 62 that is arranged and configured to sense pressure in the rod end chambers 34 of the hydraulic actuators 20. Additionally, the hydraulic system 40 can include a head end pressure sensor 64 that is arranged and configured to sense pressure in the head end chambers 32 of the hydraulic cylinders 20. The rod end and head end pressure sensors 62, 64 may be in communication with a controller so as to provide further information that can be used to direct operation of the directional valve 46.

To recover energy associated with the discharge of pressurized fluid from the hydraulic actuators 20 during certain operating conditions, the hydraulic system 40 may include an energy recovery system 65. For example, the energy recovery system 65 may recover energy when the hydraulic cylinders 20 are retracted after they have been extended to use the implement 12 to lift a load. In such a situation, the force of gravity on the implement 12 and/or on a load carried by the implement 12 can cause the pressure of the hydraulic fluid in the head end chamber 32 of the hydraulic actuators 20 to increase such that the hydraulic fluid is forced out of the hydraulic actuators 20. The energy recovery system 65 can capture and store this energy so that it can be later used to provide power for subsequent movements of the hydraulic actuators 20 or for other hydraulic devices associated with the machine 10.

In the embodiment illustrated in FIG. 2, the energy recovery system 65 includes a charge valve 66, an accumulator 68 and a hydraulic motor 70. The charge valve 66 may be operatively connected between the hydraulic actuators 20 and the accumulator 68 and between the accumulator 68 and the hydraulic motor 70. Moreover, the charge valve 66 may be configured to place the hydraulic actuators 20 in fluid communication with the accumulator 68 and to place the accumulator 68 into fluid communication with the hydraulic motor 70. In one embodiment, the charge valve 66 may be a solenoid operated spool valve being movable from a neutral position to first, second and third positions 72, 74, 76. The charge valve 66 is illustrated in a neutral position in FIG. 2. The first position 72 of the charge valve 66 may be a discharge position and the second and third positions 74, 76 of the charge valve 66 may correspond to first and second charge modes of the energy recovery system 65. In this case, the charge valve 66 includes two solenoids with movement into the first position 72 being controlled by actuation of a first solenoid 78 and movement into the second and third positions 74, 76 being controlled by actuation of a second solenoid 80. However, it will be appreciated by those skilled in the art that a single solenoid may be used to move the charge valve between its various positions. The charge valve 66 may be actuated in any suitable manner including electrically actuated, hydraulically actuated, mechanically actuated or pneumatically actuated.

As shown in FIG. 2, the accumulator 68 may be arranged in fluid communication with the charge valve 66. An accumulator pressure sensor 82 may be provided to detect the pressure of the hydraulic fluid in the accumulator 68. To provide protection against overpressure in the accumulator 68, a pressure relief valve 84 may be provided that is configured and arranged to relieve pressure in the accumulator 68 when it exceeds a predetermined level. The hydraulic motor 70 is also arranged in fluid communication with the charge valve 66 and drivably connected to the power supply 47 of the machine 10. The hydraulic motor 70 may be configured to convert the pressurized fluid from the accumulator 68 into a rotational output that can be used to provide torque assistance to the power supply 47, for example, to help drive the pump 44.

INDUSTRIAL APPLICABILITY

The hydraulic system and method described herein may be implemented in a variety of different machines in which potential energy associated with movement of an implement by a hydraulic actuator may be recovered and/or recycled. This reuse of energy may improve machine efficiency and reduce fuel costs and overall operating costs. Additionally, the disclosed hydraulic system is a relatively simple system that does not require any complicated valves or other expensive additional hardware.

In a normal operating mode of the hydraulic system 40 in which the energy recovery system 65 is not actively capturing energy discharged from the actuators 20 or using stored energy, the charge valve 66 may be in the neutral position which isolates the accumulator 66 from the rest of the hydraulic system 40. In this position, the accumulator 68 is neither charged with pressurized fluid nor is pressurized fluid discharged from the accumulator 68. To extend the actuators 20, the directional valve 46 may be actuated using, in this case, the first solenoid 54 to place the directional valve 46 into the first, extend position 48. The signal to actuate the directional valve 46 into the first, extend position 48 may originate from the operator input device 58 and corresponding sensor 60. In this position, hydraulic fluid exiting the pump 44 flows through the directional valve 46 to the head end chambers 32 of the hydraulic actuators 20 through conduit 85 while hydraulic fluid from the rod end chambers 34 of the hydraulic actuators 20 returns to the tank 42 through the directional valve 46 through conduit 87. This causes the hydraulic actuators 20 to extend. The rate at which the hydraulic actuators 20 extend may be controlled by varying the signal provided to the first solenoid 54 of the directional valve 46. To retract the actuators 20 without charging the accumulator 68, the directional valve 46 may be actuated using, in this case, the second solenoid 56 into the second, faster retract position 50. In this position, the directional valve 46 directs pressurized fluid from the outlet side of the pump 44 through conduit 87 to the rod end chambers 34 of the hydraulic actuators 20. Additionally, the directional valve 46 directs pressurized fluid forced out of the head end chambers 32 of the hydraulic actuators 20 by the retracting pistons 24 through conduit 85 to the tank 42. The speed at which the hydraulic actuators 20 retract can be controlled by, among other things, varying the amount of pump flow that reaches the rod end chambers 34.

During retraction of the hydraulic actuators 20 (e.g., to lower the machine implement 12), the energy recovery system 65 may be actuated in order to store at least a portion of the energy associated with pressurized hydraulic fluid being forced out of the head end chambers 32 of the hydraulic actuators 20 by the retracting pistons 24. According to one embodiment, the hydraulic system 40 may be switched from the fast retract mode to a first energy recovery mode after a short time delay. Alternatively, the first energy recovery mode may be initiated when the rod end pressure sensor 62 detects that the pressure in the rod end chamber 34 of the hydraulic actuators 20 has dropped to a predetermined level which indicates that the hydraulic actuators 20 are retracting fast enough. To initiate the first energy recovery mode, the directional valve 46 may be moved into the third, slower retract position 52 by its second solenoid 56. Additionally, the charge valve 66 may be moved into its second position 74, which corresponds to a first charge mode. With this configuration of the directional and charge valves 46, 66 in the illustrated embodiment, the return flow of hydraulic fluid from the head end chambers 32 of the hydraulic actuators 20 through the directional valve 46 is blocked. However, pressurized hydraulic fluid exiting from the head end chambers 32 of the hydraulic actuators 20 is able to pass along a route by a check valve 86 to the charge valve 66. This hydraulic fluid can pass through the second position 74 of the charge valve 66 to the accumulator 68, which can throttle the fluid increasing its pressure, thereby converting the kinetic energy of the hydraulic actuators 20 to hydraulic potential energy.

During energy recovery operation if the accumulator 68 becomes charged with a high enough pressure or one or more other machine functions are active at same time that require the power source 47 to deliver additional power, the energy recovery system 65 can operate in a second charge mode. More specifically, under such circumstances, the charge valve 66 may be moved to the third position 76, corresponding to the second charge mode. In this position, at least some of the pressurized fluid from the head end chambers 32 of the hydraulic actuators 20 continues to pass through the charge valve 66 and charge the accumulator 68. However, in the third position 76, at least some of the pressurized fluid discharging from the head end chambers 32 is directed by the charge valve 66 to the hydraulic motor 70 which helps the power source 47 to drive the pump 44 hence recovering the stored energy.

When an operator indicates that movement of the hydraulic actuators 20 should stop such as through the operator input device 58, both the directional valve 46 and the charge valve 66 move back to their respective neutral positions. With the directional and charge valves 46, 66 in these positions, the ports 36, 38 for the head and rod end chambers of the hydraulic actuators 20 are blocked. Under these circumstances, if the accumulator pressure sensor 82 detects that the pressure in the accumulator 68 exceeds a predetermined value, the charge valve 66 can be moved to the first (discharge) position 72 by actuating the first solenoid 78 of the charge valve 66. When the charge valve 66 is in the first (discharge) position 72, the pressurized hydraulic fluid from the accumulator 68 is allowed to discharge to the hydraulic motor 70 through the charge valve 66 to help the power source 47 drive the pump 44. The charge valve 66 may also be moved to the first (discharge) position 72 when the hydraulic actuators 20 are being extended. In such a situation, the directional valve 46 in its first (extend) position 48 and the charge valve 66 is in its first (discharge) position 72. With this configuration of the directional and charge valves 46, 66, pressurized fluid discharged from the pump 44 flows through the directional valve 46 to the head end chambers 32 of the hydraulic actuators 20 and the hydraulic fluid from the rod end chambers 34 of the hydraulic actuators returns back to tank 42 through the directional valve 46. Additionally, pressurized fluid from the accumulator 68 is allowed to pass through the charge valve 66 to the hydraulic motor 70 to help, for example, the power source 47 drive the pump 42.

The hydraulic system 40 can further include a back pressure valve 88. The back pressure valve 88 can be arranged in the return line 90 from the hydraulic actuators 20 to the tank 42 and can be configured to force the pressurized hydraulic fluid exiting the hydraulic actuators 20 to route through the hydraulic motor 70 when the charge valve 66 closes the discharge line from the accumulator 68 or when there is not enough pressure in the discharge line.

To boost the pump 44 supply flow as needed, the hydraulic system 40 may also further include a regeneration valve 92 that can be used to boost the pump supply flow using hydraulic fluid from either the head or rod end chamber 32, 34 of the hydraulic actuators 20. The regeneration valve 92 can be arranged between the head and rod end ports 36, 38 of the hydraulic actuators 20 and may be configured to be controlled by a pilot proportional valve 94. The pilot proportional valve 94 may, in turn, be configured such when the hydraulic actuators 20 are being retracted with the energy recovery system 65 operational, the pilot proportional valve 94 opens the regeneration valve 92 if the head and rod end pressure sensors 64, 62 detect a pressure differential between head and rod end chambers 32, 34 that exceeds a predetermined amount. When the regeneration valve 92 is open, some of the pressurized hydraulic fluid flow exiting from the head end chamber 32 is directed to the rod end chamber 34 in order to boost the flow of pressurized fluid from the pump 44. At the same time, the position of the charge valve 66 may be adjusted to compensate for this variance so to maintain a smooth retraction of the hydraulic actuators 20.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A hydraulic system comprising:

a hydraulic actuator;

a pump configured to supply pressurized fluid to the hydraulic actuator; and an energy recovery system including a hydraulic motor, a charge valve and an accumulator configured to store fluid from the hydraulic actuator, the charge valve being operatively connected between the hydraulic actuator and the accumulator and between the accumulator and the hydraulic motor and being configured to selectively place the hydraulic actuator in fluid communication with the accumulator and to selectively place the accumulator in fluid communication with the hydraulic motor; and a directional valve operatively connected between the pump and the hydraulic actuator, the directional valve being configured to selectively place the pump in fluid communication with the hydraulic actuator and being configured to selectively direct the flow of hydraulic fluid exiting the hydraulic actuator to the charge valve in an energy recovery mode.

2. The hydraulic system according to claim 1, wherein the directional valve is movable between a first position and a second position and wherein in the first position the directional valve places the pump in fluid communication with a first chamber of the hydraulic actuator and places a second chamber of the hydraulic actuator in communication with a tank and wherein in the second position the directional valve places the pump in fluid communication with the second chamber of the hydraulic actuator and places the first chamber of the hydraulic actuator in communication with the tank.

3. The hydraulic system according to claim 2, wherein the directional valve is movable into a third position in which the directional valve places the pump in fluid communication with the second chamber of the hydraulic actuator and places the first chamber of the hydraulic actuator in communication with the charge valve.

4. The hydraulic system according to claim 3, wherein the charge valve is movable between a first position and a second position and wherein in the first position the charge valve places the accumulator in fluid communication with the hydraulic motor.

5. The hydraulic system according to claim 4, wherein in the second position the charge valve places the first chamber of the hydraulic actuator in communication with the accumulator.

6. The hydraulic system according to claim 5, wherein the charge valve is movable into a third position in which the charge valve places the first chamber of the hydraulic actuator in communication with the accumulator and places the accumulator in fluid communication with the hydraulic motor.

7. The hydraulic system according to claim 1, further including a power source operatively connected to the pump and wherein the hydraulic motor is operatively connected to the power source.

8. The hydraulic system according to claim 1, further including a regeneration valve for selectively placing a first chamber of the hydraulic actuator in communication with a second chamber of the hydraulic actuator.

9. A machine comprising:

a work implement;

a hydraulic system configured to actuate the work implement, the hydraulic system including:

a hydraulic actuator having a first end chamber and a second end chamber;

a pump configured to supply pressurized fluid to the hydraulic actuator; and an energy recovery system including a hydraulic motor, a charge valve and an accumulator configured to store fluid from the hydraulic actuator, the charge valve being operatively connected between the hydraulic actuator and the accumulator and between the accumulator and the hydraulic motor and being configured to selectively place the hydraulic actuator in fluid communication with the accumulator and to selectively place the accumulator in fluid communication with the hydraulic motor; and a directional valve operatively connected between the pump and the hydraulic actuator, the directional valve being configured to selectively place the pump in fluid communication with the first chamber of the hydraulic actuator and to selectively place the pump in fluid communication with the second chamber of the hydraulic actuator, the directional valve being configured to selectively direct the flow of hydraulic fluid exiting the hydraulic actuator to the charge valve.

10. The machine according to claim 9, wherein the directional valve is movable between a first position and a second position and wherein in the first position the directional valve places the pump in fluid communication with a first chamber of the hydraulic actuator and places a second chamber of the hydraulic actuator in communication with a tank and wherein in the second position the directional valve places the pump in fluid communication with the second chamber of the hydraulic actuator and places the first chamber of the hydraulic actuator in communication with the tank.

11. The machine according to claim 10, wherein the directional valve is movable into a third position in which the directional valve places the pump in fluid communication with the second chamber of the hydraulic actuator and places the first chamber of the hydraulic actuator in communication with the charge valve.

12. The machine according to claim 11, wherein the charge valve is movable between a first position and a second position and wherein in the first position the charge valve places the accumulator in fluid communication with the hydraulic motor.

13. The machine according to claim 12, wherein in the second position the charge valve places the first chamber of the hydraulic actuator in communication with the accumulator.

14. The machine according to claim 13, wherein the charge valve is movable into a third position in which the charge valve places the first chamber of the hydraulic actuator in communication with the accumulator and places the accumulator in fluid communication with the hydraulic motor.

15. The machine according to claim 9, further including a power source operatively connected to the pump and wherein the hydraulic motor is operatively connected to the power source.

16. The machine according to claim 9, further including a regeneration valve for selectively placing a first chamber of the hydraulic actuator in communication with a second chamber of the hydraulic actuator.

17. A method for recovering energy in a hydraulic circuit including a pump and a hydraulic cylinder, the method comprising:

directing fluid exiting the hydraulic actuator to an accumulator using a directional valve and a charge valve in a first operating condition;

directing fluid from the hydraulic actuator to the accumulator and to a hydraulic motor using the directional valve and the charge valve in a second operating condition; and directing fluid from the accumulator to the hydraulic motor using the charge valve in a third operating condition.

18. The method according to claim 17, further including the step of blocking hydraulic fluid from reaching the accumulator using the directional valve in a fourth operating condition.

19. The method according to claim 17, wherein the directional valve and the charge valve are spool valves.

20. The method according to claim 17, further including the step of selectively placing a first chamber of the hydraulic actuator in communication with a second chamber of the hydraulic actuator with a regeneration valve.

* * * * *